US011892278B1

(12) United States Patent
Yao et al.

(10) Patent No.: US 11,892,278 B1
(45) Date of Patent: Feb. 6, 2024

(54) METHOD FOR REMOVING SECTION STEEL CONCRETE COLUMN

(71) Applicant: JIANGHAN UNIVERSITY, Wuhan (CN)

(72) Inventors: Yingkang Yao, Wuhan (CN); Shanshan Yu, Wuhan (CN); Yongsheng Jia, Wuhan (CN); Xinzhe Nian, Wuhan (CN); Jinshan Sun, Wuhan (CN); Quanmin Xie, Wuhan (CN); Xiaowu Huang, Wuhan (CN); Changbang Liu, Wuhan (CN); Dezhi Chen, Wuhan (CN)

(73) Assignee: JIANGHAN UNIVERSITY, Wuhan (CN)

( * ) Notice: Subject to any disclaimer, the term of this patent is extended or adjusted under 35 U.S.C. 154(b) by 0 days.

(21) Appl. No.: 18/355,306

(22) Filed: Jul. 19, 2023

(30) Foreign Application Priority Data

Oct. 8, 2022 (CN) ..... 202211221747.0

(51) Int. Cl.
*F42D 3/02* (2006.01)
*E04G 23/08* (2006.01)

(52) U.S. Cl.
CPC ..... *F42D 3/02* (2013.01); *E04G 23/08* (2013.01)

(58) Field of Classification Search
CPC ..... F42D 3/02; E04G 23/08
See application file for complete search history.

(56) References Cited

U.S. PATENT DOCUMENTS

2006/0266204 A1* 11/2006 Givens ..... F42B 1/02 102/293
2014/0318335 A1* 10/2014 Shindo ..... F42D 3/02 83/13

FOREIGN PATENT DOCUMENTS

| | | | | |
|---|---|---|---|---|
| CN | 1757861 A | 4/2006 | | |
| CN | 105444623 A | 3/2016 | | |
| CN | 106679519 A | 5/2017 | | |
| CN | 113152928 A | 7/2021 | | |
| WO | WO-2008110682 A1 * | 9/2008 | ..... | E04G 23/08 |

* cited by examiner

*Primary Examiner* — Bret Hayes
(74) *Attorney, Agent, or Firm* — Nitin Kaushik

(57) ABSTRACT

The present application relates to the technical field of removing a section steel concrete column, and more particularly, the present application relates to a method for removing a section steel concrete column, comprising: determining a pre-blasting portion of the section steel concrete column according to a height dimension of the section steel concrete column; cutting a pre-blasting portion to obtain an initiation position, part of section steel being exposed at the section steel concrete column at the initiation position; a blasting object being provided at the part of section steel at concrete at the initiation position, the blasting object provided at the part of the section steel being a linear energy-concentrating cutter; detonating the blasting object to remove the section steel concrete column.

8 Claims, 4 Drawing Sheets

METHOD FOR REMOVING SECTION STEEL CONCRETE COLUMN

CROSS-REFERENCE TO RELATED APPLICATIONS

The application claims priority to Chinese patent application No. 2022112217470, filed on Oct. 8, 2022, the entire contents of which are incorporated herein by reference.

TECHNICAL FIELD

The present application relates to the technical field of safe and green removing of high-rise buildings, and more particularly, the present application relates to a method for removing a section steel concrete column.

BACKGROUND

The method for removing a section steel concrete columns are mainly composed of concrete, section steel, longitudinal steel bars and stirrups. It differs from the traditional steel bar reinforced concrete column mainly in that section steel is placed in the original steel bar reinforced concrete column component, addition of steel can effectively improve the bearing capacity of the component and reduce the axial compression ratio of the component. Section steel concrete columns have the advantages of high strength, small cross-section size, strong grip with concrete, saving concrete, increasing use space, reducing engineering cost and improving engineering quality. At present, section steel concrete columns have been widely used in high-rise and super high-rise building load-bearing columns.

However, while giving full play to their structural advantages, it is extremely difficult to remove the section steel concrete columns due to their special structure. In mechanical breaking and rope saw cutting, construction is difficult, removing time is long, dust and noise pollution is serious during breaking, and it is very prone to major safety accidents due to sudden structural instability during the working process; although the blasting removing method has the advantages of high operation efficiency and good construction safety, it can not destroy the large-size section steel inside the column. At present, the removing methods applied to steel bar reinforced concrete columns are not safe and efficient to remove the section steel concrete column.

Accordingly, there is a need for a method for removing a section steel concrete column that at least partially solves the problems of the prior art.

SUMMARY

A series of concepts in simplified form are introduced in the Summary section, which is described in further detail in the Detailed Description section. This Summary of the present disclosure is not intended to limit the key features and essential features of the claimed subject matter, nor is it intended to determine the scope of the claimed subject matter.

The present disclosure aims to at least solve one of the technical problems existing in the prior art or related art.

To this end, the present disclosure provides a method for removing a section steel concrete column.

In view of this, according to an embodiment of the present application, there is provided a method for removing a section steel concrete column, comprising:

determining a failure portion of the section steel concrete column according to a height dimension of the section steel concrete column;

crushing the failure portion to obtain a blasting position, part of section steel of the section steel concrete column being exposed at the blasting position;

a blasting object being provided at concrete and the part of the section steel at the blasting position, the blasting object provided at the part of the section steel being a linear energy-concentrating cutter;

detonating the blasting object to remove the section steel concrete column. In one possible implementation, the method for removing a section steel concrete column further comprises:

the failure portion being located at two ends of the section steel concrete column, and a length of the failure portion being ¼ to ⅓ of a length of the section steel concrete column.

In one possible implementation, the step of crushing the failure portion to obtain a blasting position comprises:

crushing part of concrete at the failure portion by means of mechanical crushing to obtain a crushed portion;

cutting an exposed steel bar at the crushed portion to obtain the blasting position;

the blasting positions on the two ends of the section steel concrete column being centred on a centre line of the section steel concrete column in a centrosymmetric relationship.

In one possible implementation, a width of the concrete at the blasting position is less than or equal to ½ of a width of the section steel concrete column.

In one possible implementation, the step of a blasting object being provided at the part of the section steel at concrete at the blasting position comprises:

drilling a blast hole at the concrete at the blasting position, filling the blast hole with an explosive and a first detonator;

mounting the linear energy-concentrating cutter and a second initiation detonator at a flange plate of the section steel and a web of the section steel exposed at the blasting position.

In one possible implementation, the linear energy-concentrating cutter comprises:

a housing, a detonator insertion hole being provided on the housing for mounting the second initiation detonator, a shaped charge cover being formed on one side, close to the section steel concrete column, of the housing and an accommodating space being formed between the housing and the shaped charge cover for accommodating the explosive;

an energy-concentrating cavity attached to the shaped charge cover, part of the section steel, toward the blasting position, of the section steel concrete column being exposed;

the housing and the energy-concentrating cavity being of a conical shape.

In one possible implementation, a side where part of the section steel of the section steel concrete column is exposed, adjacent to the blasting position, of the energy-concentrating cavity, is coated with a red copper film.

In one possible implementation, the method for removing a section steel concrete column further comprises:

clustering a corner line of the first initiation detonator and a corner line of the second initiation detonator to establish an initiation network.

In one possible implementation, the step of mounting the linear energy-concentrating cutter and a second initiation detonator at a flange plate of the section steel and a web of the section steel exposed at the blasting position comprises:

acquiring thickness data and material parameter of the flange plate and the web;

determining an opening angle, a size, an embedded explosive type, a charge amount and a setting position of the linear energy-concentrating cutter mounted at the flange plate and the web according to the thickness data and the material parameter of the flange plate and the web.

In one possible implementation, each of the blast holes has a diameter of 40 mm to 42 mm, adjacent blast holes are spaced 200 mm to 400 mm apart, and the explosive charged in the blast holes has a diameter of 30 mm to 32 mm.

Compared to the prior art, the present disclosure comprises at least the following advantages: embodiments of the present application provide a method for removing a section steel concrete column by determining a failure portion of the section steel concrete column according to a height dimension of the section steel concrete column; crushing the failure portion to obtain a blasting position, part of section steel of the section steel concrete column being exposed at the blasting position; a blasting object being provided at concrete and the part of the section steel at the blasting position, the blasting object provided at the part of the section steel being a linear energy-concentrating cutter; detonating the blasting object to remove the section steel concrete column. By determining the failure portion of the section steel concrete column, the mechanical failure mode on the failure portion is used to determine the blasting position, and then the blasting object is set for the concrete at the blasting position, and the linear energy-concentrating cutter is set for the section steel exposed at the blasting position, so as to complete the simultaneous blasting of different materials, reduce the amount of explosive, and effectively destroy the steel bar reinforced concrete and section steel structure of the section steel concrete column, and ensure the reliable failure and instability of the section steel concrete column. In addition, the integrity of the section steel in the section steel concrete column can be ensured before the initiation work, so as to ensure the load-bearing performance of the section steel concrete column, and the sudden instability and collapse of the building can be avoided during the removing process, so as to ensure the safety of the removing work.

Regarding the method for removing a section steel concrete column of the present disclosure, additional advantages, objects, and features of the present disclosure will be set forth in part in the description which follows and in part will become apparent to those having ordinary skill in the art upon research and practice of the present disclosure.

BRIEF DESCRIPTION OF DRAWINGS

Various other advantages and benefits will become apparent to those having ordinary skill in the art upon reading the following detailed description of the preferred implementations. The drawings are only for purposes of illustrating the preferred implementations and are not to be construed as limiting the description. Moreover, like reference numerals designate like parts throughout the several views. In the drawings.

Figure 1:
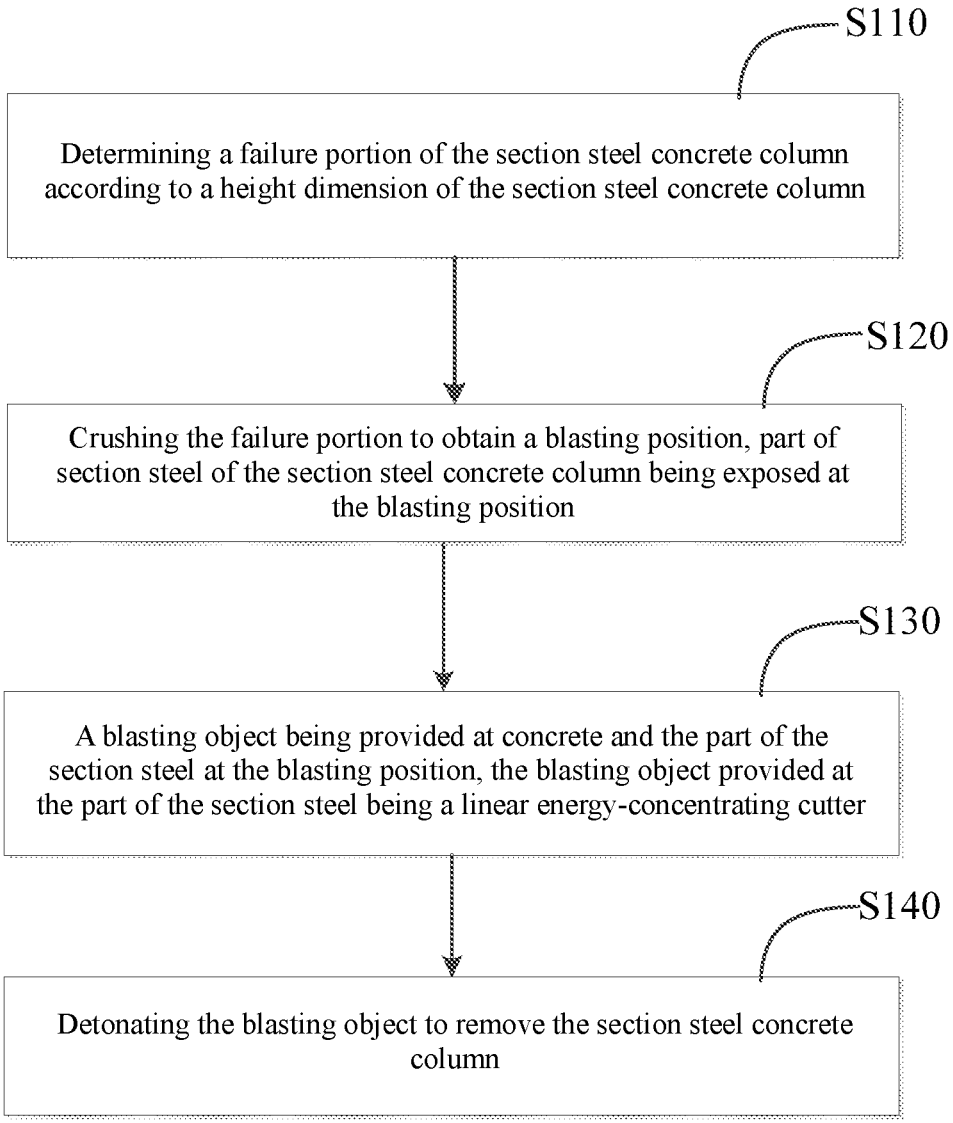
FIG. 1 is a schematic flow chart of a method for removing a section steel concrete column according to an embodiment of the present application.
Figure 2:
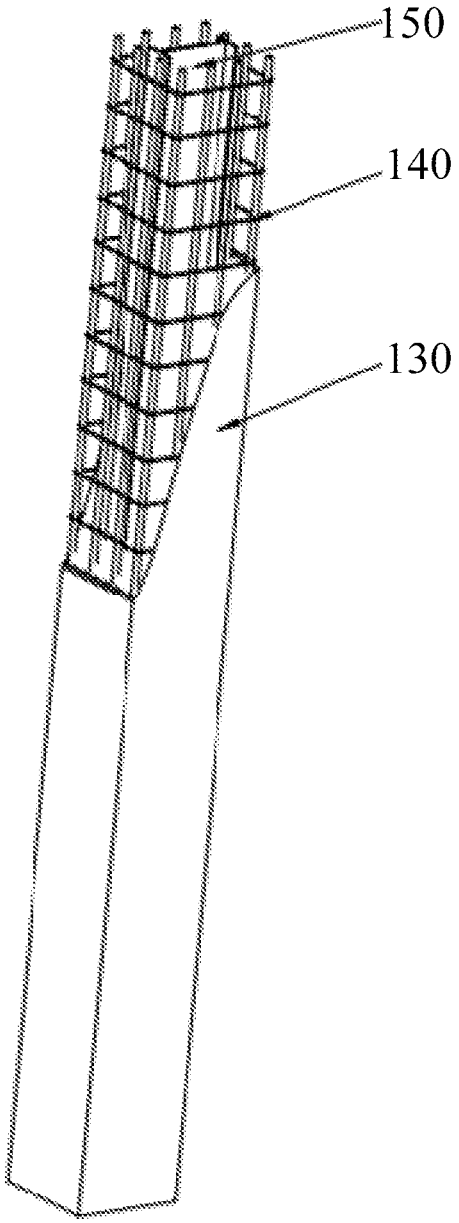
FIG. 2 is a schematic structural diagram of a section steel concrete column according to an embodiment of the present application.
Figure 3:
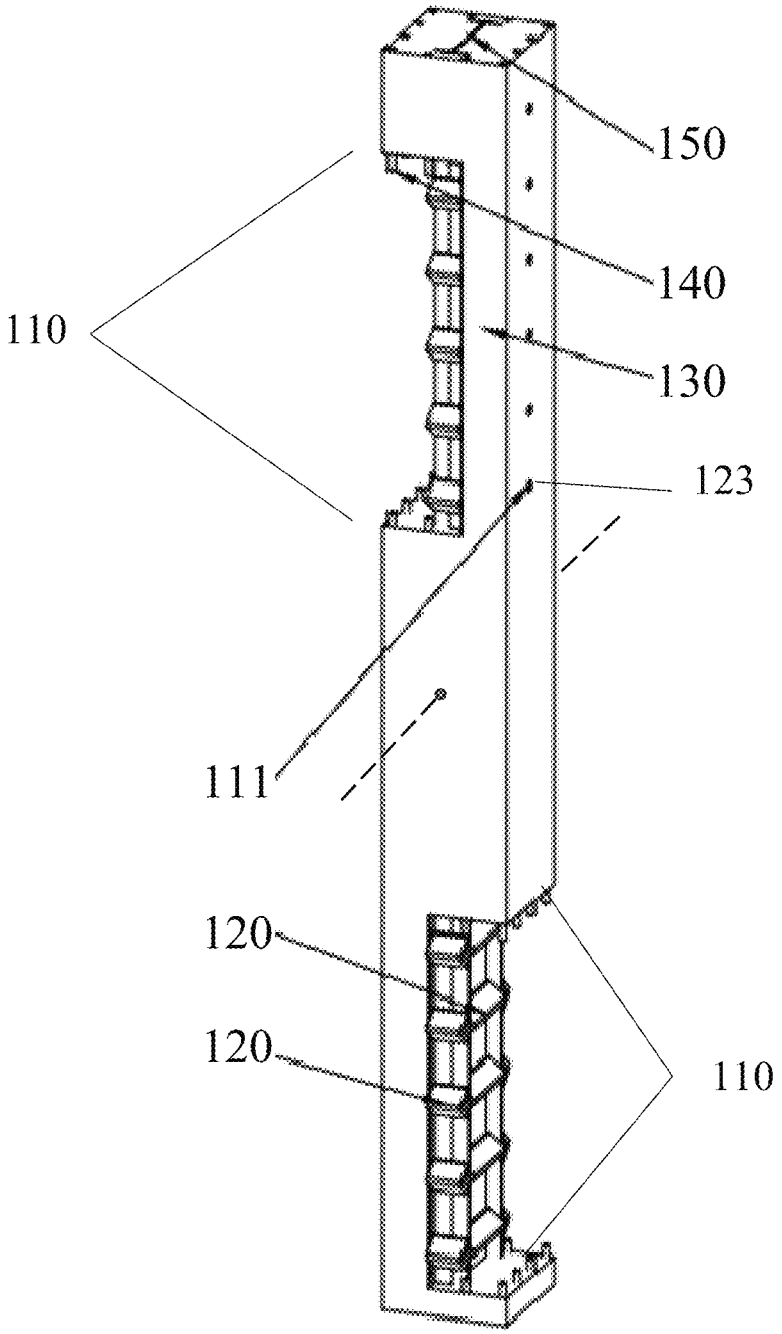
FIG. 3 is a schematic structural diagram of a blasting method for a section steel concrete column according to an embodiment of the present application.
Figure 4:
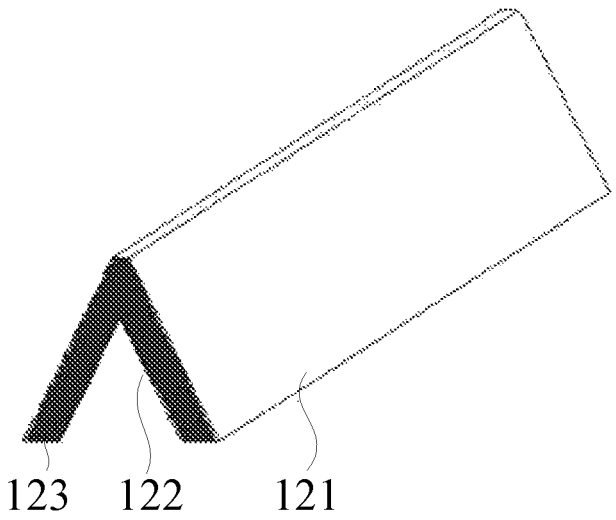
FIG. 4 is a schematic structural diagram of a linear energy-concentrating cutter according to an embodiment of the present application.

The corresponding relationship between the reference signs and the component names in FIGS. 2 to 4 is as follows:

110 blasting position, 111 blast hole, 120 linear energy-concentrating cutter, 121 housing, 122 energy-concentrating cavity, 123 explosive, 130 concrete, 140 steel bar, 150 section steel.

DETAILED DESCRIPTION OF THE EMBODIMENTS

In order to better understand the above-mentioned technical solutions, the technical solutions of the embodiments of the present application are described in detail below through the figures and specific embodiments. It should be understood that the embodiments of the present application and the specific features in the embodiments of the present application are detailed descriptions of the technical solutions of the embodiments of the present application rather than limitations of the technical solutions of the present application, and the embodiments of the present application and the technical features in the embodiments of the present application can be combined with each other without conflict.

As shown in FIGS. 1 to 4, according to an embodiment of the present application, there is provided a method for removing a section steel concrete column, comprising:

S110: determining a failure portion of the section steel concrete column according to a height dimension of the section steel concrete column.

It will be appreciated that depending on the actual height dimension of the section steel concrete column, the failure location of the section steel concrete column may be determined to use less explosives, destabilize the section steel concrete column, reduce the amount of explosive 123, and reduce the harmful effects of blasting.

S120: The failure portion is crushed to obtain a blasting position 110, part of section steel 150 of the section steel concrete column being exposed at the blasting position 110.

It will be appreciated that, in view of the structural characteristics of the section steel concrete columns, the outer layer of the section steel 150 structure is wrapped with the steel bar 140 reinforced concrete 130 structure, and in order to ensure the removal of the section steel 150, the steel bar 140 reinforced concrete 130 on the outer layer thereof needs to be crushed to expose part of the section steel 150 structure so as to determine the blasting position 110 to facilitate the mounting of explosives to the section steel 150 structure.

S130 A blasting object is provided at concrete 130 and the part of the section steel 150 at the blasting position 110, the blasting object provided at the part of the section steel 150 being a linear energy-concentrating cutter 120.

It will be appreciated that the concrete 130 at the blasting position 110 is provided with a blasting object, and in particular, the blasting object at the concrete portion is a drilling hole-filling explosive, and the explosive may be an emulsion explosive. A linear energy-concentrating cutter 120 is mounted to the part of the section steel 150 exposed at the blasting position 110. The steel bar 140 reinforced concrete 150 and section steel 150 structure of the section steel concrete column can be destroyed effectively by blasting the materials of different parts simultaneously.

S140 The blasting object is detonated to remove the section steel concrete column.

It can be understood that the linear energy-concentrating cutter 120 is mounted to detonate the emulsion explosive in the concrete 130 at the blasting position 110 and the part of the section steel 150 exposed at the blasting position 110, so as to complete the destruction of the blasting position 110 of the section steel concrete column, so that the section steel concrete column becomes unstable, so as to complete the removing work.

In conclusion, compared with the existing single mechanical cutting or blasting removing method, the above-mentioned method for removing a section steel concrete column has the advantages of less construction difficulty, high construction safety and short working time, effectively reducing the noise and dust generated by removing, and ensuring the reliable destruction and instability of the section steel concrete column. In addition, the integrity of the section steel 150 in the section steel concrete column can be ensured in the construction work before the initiation, so as to ensure the load-bearing performance of the section steel concrete column, and the sudden instability and collapse of the building is avoided during the removing process, so as to ensure the safety of the removing work.

In some examples, as shown in FIGS. 2 to 3, the method for removing a section steel concrete column further includes that:

the failure portion being located at two ends of the section steel concrete column, and a length of the failure portion being ¼ to ⅓ of a length of the section steel concrete column.

It will be appreciated that in a demolished building, the two ends of the section steel concrete columns are connected to the beams or floors of the upper and lower floors, respectively, to exert the load bearing characteristics of the columns. When the failure position of the section steel concrete column is determined according to the actual height dimension of the section steel concrete column, blasting damage to the two ends of the section steel concrete column can cause multi-section fracture damage of the section steel concrete column, eventually leading to instability of the building structure and completing the removing operation. So configured, the amount of explosives is reduced, while simultaneously costs are saved and the harmful effects of blasting are reduced. Specifically, the pre-blasting positions are at the upper and lower ends of the section steel concrete column, and the length of the failure portion at each end is ¼ to ⅓ of the length of the section steel concrete column, so that the middle section of the section steel concrete column is a complete structure, and in the construction work, the remaining structure at the middle section and the failure portion still has sufficient bearing characteristics to avoid sudden instability and collapse of the building in the removing work.

In some examples, as shown in FIGS. 2 and 3, the step of crushing the failure portion to obtain a blasting position 110 comprises:

crushing part of concrete 130 at the failure portion by means of mechanical crushing to obtain a crushed portion;

cutting an exposed steel bar 140 at the crushed portion to obtain the blasting position 110;

the blasting positions 110 on the two ends of the section steel concrete column being centred on a centre point of the section steel concrete column in a centrosymmetric relationship.

It can be understood that a part of the steel bar 140 reinforced concrete 130 at the failure portion is crushed by mechanical crushing such as pneumatic picks and hydraulic crushing to obtain a crushed portion, and a part of the steel bar 140 is exposed at the crushed portion. The steel bar 140 exposed at the crushed portion is cut, and after the concrete 130 and the steel bar 140 are removed, a blasting position 110 is obtained, wherein the section steel 150 and a part of the remaining steel bar 140 reinforced concrete 130 are exposed at the blasting position 110. The blasting position 110 still provides support to the superstructure of the building prior to detonation.

The blasting positions 110 on the two ends of the section steel concrete column are centred on a centre point of the section steel concrete column in a centrosymmetric relationship, so as to avoid the situation that the blasting position 110 of the two ends of the section steel concrete column is on the same side, the section steel concrete column is unbalanced in force, and sudden instability occurs. It is necessary to ensure that the section steel concrete column at blasting position 110 has sufficient bearing capacity from the start of construction to the final blasting in the construction process to ensure the safety of the removing work.

It will be appreciated that the section steel 150 may be an H-section steel 150 having a flange plate and web structure.

In some examples, a width of the concrete 130 at the blasting position 110 is less than or equal to ½ of a width of the section steel concrete column.

It will be appreciated that a width of the concrete 130 remaining at the blasting position 110 is less than or equal to ½ of a width of the section steel concrete column. It is avoided that the width of the concrete 130 remaining at the blasting position 110 is too large, which increases the amount of explosive and increases the difficulty of damaging the section steel 150. Simultaneously, it is not easy for the width of the concrete 130 remaining at the blasting position 110 to be too small, so as to ensure that the section steel concrete column still has sufficient bearing capacity during the construction working process.

In some examples, the step of a blasting object being provided at the part of the section steel 150 at concrete 130 at the blasting position 110 comprises:

drilling a blast hole 111 at the concrete 130 at the blasting position 110, filling the blast hole 111 with an explosive 123 and a first detonator;

mounting the linear energy-concentrating cutter 120 and a second initiation detonator at a flange plate of the section steel 150 and a web of the section steel 150 exposed at the blasting position 110.

It will be appreciated that in the setting of explosives, the concrete 130 remaining at the blasting position 110 is drilled to obtain a blast hole 111, the explosives filled in the blast hole 111 being commonly used emulsion explosives at which a first detonator is connected. The linear energy-concentrating cutter 120 is mounted at the flange plate and the web of the section steel 150 exposed at the blasting position 110, and the retained steel bar reinforced concrete 130 structure can be crushed by drilling and blasting, and after the linear energy-concentrating cutter 120 is initiated, the detonation product jet generated by the cutter cuts the section steel 150, so that the section steel 150 is reliably broken. Under the synchronous action of drilling hole blasting and linear energy-concentrating cutting blasting, the multi-section fracture failure instability of the section steel concrete column occurs, and the removal is completed finally.

It will be appreciated that the explosive 123 in the bore hole 111 may be selected from conventional emulsion explosives, which are relatively inexpensive and safe to use.

In some examples, as shown in FIG. 4, the linear energy-concentrating cutter 120 includes: a housing, wherein the housing is provided with a detonator insertion hole for mounting the second initiation detonator, a shaped charge cover is formed on one side, close to the section steel concrete column, of the housing, and an accommodating space is formed between the housing and the shaped charge cover for accommodating an explosive; an energy-concentrating cavity attached to the shaped charge cover, a part of the section steel, toward the blasting position, of section steel concrete column being exposed, wherein the housing and the energy-concentrating cavity are of a conical shape.

It can be understood that the energy-concentrating cavity 120 is provided with the housing 121, wherein the housing 121 is a linear housing 121, the detonator insertion hole is provided on the housing 121 for mounting the above-mentioned second initiation detonator, the shaped charge cover 122 is formed on one side, close to the section steel concrete column, of the housing 121, the accommodating space is formed between the housing and the shaped charge cover, and the explosive 123 can be accommodated in the accommodating space. The energy-concentrating cavity 122 is attached to the shaped charge cover, and part of the section steel, toward the blasting position, of the section steel concrete column is exposed. In use, one side of the energy-concentrating cavity is attached to the flange plate and the web of the section steel 150, and the explosive 123 in the accommodating space is detonated by the detonator, and under the energy-concentrating effect, a detonation generated jet and a metal jet are formed at the explosive 123 and the energy-concentrating cavity 122, and the section steel 150 is cut together, so that the section steel 150 is broken.

In some examples, a side where part of the section steel of the section steel concrete column is exposed, adjacent to the blasting position, of the energy-concentrating cavity, is coated with a red copper film.

It can be understood that under the energy-concentrating effect, the red copper film at the explosives 123 and 122 forms detonation generated jet and metal jet to cut the section steel 150 together, thereby breaking the section steel 150 and improving the cutting effect on the section steel 150.

In some examples, the method for removing a section steel concrete column further includes:

clustering a corner line of the first initiation detonator and a corner line of the second initiation detonator to establish an initiation network.

It will be appreciated that after completion of the mounting of the explosive 123 and the first initiation detonator to the blast hole 111 and the mounting of the In some examples, 120 and the second initiation detonator to the flange plate and web of the section steel 150, the corner line of the first initiation detonator and the corner line of the second initiation detonator are clustered together to form an initiation network to simultaneously initiate the explosive 123 in the blast hole 111 and the explosive 123 in the linear energy-concentrating cutter 120. Thus, the concrete 130 and the section steel 150 at the blasting position 110 are destroyed simultaneously, so that the section steel concrete is destroyed and destabilized, and the removing work is completed.

In some examples, the step of mounting the linear energy-concentrating cutter 120 and a second initiation detonator at a flange plate of the section steel 150 and a web of the section steel 150 exposed at the blasting position 110 includes:

acquiring thickness data and material parameter of the flange plate and the web;

determining an opening angle, a size, an embedded explosive 123 type, a charge amount and a setting position of the linear energy-concentrating cutter 120 mounted at the flange plate and the web according to the thickness data and the material parameter of the flange plate and the web.

It will be appreciated that upon mounting of the linear energy-concentrating cutter 120 to the section steel 150, thickness data of the flange plate and web of the section steel 150 and selected material parameters may be obtained to determine the opening angle of the linear energy-concentrating cutter 120 used, the amount of explosive 123 placed in the accommodating space, the dimensional parameters of the linear energy-concentrating cutter 120, the position of the setting and the number of settings. The jet pressure generated by the linear energy-concentrating cutter 120 is thus determined to ensure the cutting effect on the section steel 150. It can be understood that the opening angle of the linear energy-concentrating cutter 120 should be greater than 60° and less than 120°, so as to generate two detonation wave fronts with an included angle of greater than 60° and less than 120°, and the arrangement is such that when the two detonation wave fronts with an included angle of less than 120° collide together, oblique reflection or even Mach reflection will be generated, so as to enhance the power of the explosive 123 and improve the cutting effect on the section steel 150.

In the description of the present disclosure, it should be noted that the orientation or positional relationship indicated by the terms "upper", "lower", "left", "right", "front", "rare", etc. is based on the orientation or positional relationship shown in the drawings, merely to facilitate the description of the present disclosure and simplify the description, and does not indicate or imply that the devices or units referred to must have a particular orientation, be constructed and operated in a particular orientation, and thus should not be construed as limiting the present disclosure.

In the description of this specification, descriptions of the terms "an embodiment", "some embodiments", "specific embodiments", etc. mean that a particular feature, structure, material, or characteristic described in connection with the embodiment or example is included in at least one embodiment or example of the present disclosure. In this specification, schematic representations of the above-mentioned terms are not necessarily directed to the same embodiment or example. Furthermore, the particular features, structures, materials, or characteristics described may be combined in any suitable manner in any one or more embodiments or examples.

The foregoing is merely a preferred embodiment of the present disclosure, and is not intended to limit the present disclosure, it will be understood by those having ordinary skill in the art that various changes may be made of the present disclosure. Thus, it is intended that the scope of protection of the present disclosure cover the modifications, equivalents, and improvements falling within the spirit and principle of the present disclosure.

What is claimed is:

1. A method for removing a section steel concrete column, comprising:

determining a failure portion of the section steel concrete column according to a height dimension of the section steel concrete column;

crushing the failure portion to obtain a blasting position, part of section steel of the section steel concrete column being exposed at the blasting position;

a blasting object being provided at concrete and the part of the section steel at the blasting position, the blasting object provided at the part of the section steel being a linear energy-concentrating cutter;

detonating the blasting object to remove the section steel concrete column;

the failure portion being located at two ends of the section steel concrete column, and a length of the failure portion being ¼ to ⅓ of a length of the section steel concrete column;

the step of crushing the failure portion to obtain a blasting position comprising: crushing part of concrete at the failure portion by means of mechanical crushing to obtain a crushed portion;

cutting an exposed steel bar at the crushed portion to obtain the blasting position;

the blasting positions on the two ends of the section steel concrete column being centred on a centre line of the section steel concrete column in a centrosymmetric relationship.

2. The method for removing a section steel concrete column according to claim 1, wherein a width of the concrete at the blasting position is less than or equal to ½ of a width of the section steel concrete column.

3. The method for removing a section steel concrete column according to claim 1, wherein the step of a blasting object being provided at concrete and the part of the section steel at the blasting position comprises:

drilling a blast hole at the concrete at the blasting position, filling the blast hole with an explosive and a first detonator;

mounting the linear energy-concentrating cutter and a second initiation detonator at a flange plate of the section steel and a web of the section steel exposed at the blasting position.

4. The method for removing a section steel concrete column according to claim 3, wherein the linear energy-concentrating cutter comprises:

a housing, a detonator insertion hole being provided on the housing for mounting the second initiation detonator, a shaped charge cover being formed on one side, close to the section steel concrete column, of the housing and an accommodating space being formed between the housing and the shaped charge cover for accommodating the explosive;

an energy-concentrating cavity attached to the shaped charge cover, part of the section steel, toward the blasting position, of the section steel concrete column being exposed;

the housing and the energy-concentrating cavity being of a conical shape.

5. The method for removing a section steel concrete column according to claim 4, wherein a side where part of the section steel of the section steel concrete column is exposed, adjacent to the blasting position, of the energy-concentrating cavity, is coated with a red copper film.

6. The method for removing a section steel concrete column according to claim 3, further comprising:

clustering a corner line of the first initiation detonator and a corner line of the second initiation detonator to establish an initiation network.

7. The method for removing a section steel concrete column according to claim 3, wherein the step of mounting the linear energy-concentrating cutter and a second initiation detonator at a flange plate of the section steel and a web of the section steel exposed at the blasting position comprises:

acquiring thickness data and material parameter of the flange plate and the web;

determining an opening angle, a size, an embedded explosive type, a charge amount and a setting position of the linear energy-concentrating cutter mounted at the flange plate and the web according to the thickness data and the material parameter of the flange plate and the web.

8. The method for removing a section steel concrete column according to claim 3, wherein each of the blast holes has a diameter of 40 mm to 42 mm, adjacent blast holes are spaced 200 mm to 400 mm apart, and the explosive charged in the blast holes has a diameter of 30 mm to 32 mm.

* * * * *